US008209823B2

(12) United States Patent
Apicella

(10) Patent No.: US 8,209,823 B2
(45) Date of Patent: Jul. 3, 2012

(54) BELAY AND/OR RAPPELLING ACCESSORY

(76) Inventor: Norbert Apicella, Marseilles (FR)

( * ) Notice: Subject to any disclaimer, the term of this patent is extended or adjusted under 35 U.S.C. 154(b) by 286 days.

(21) Appl. No.: 12/531,926

(22) PCT Filed: Mar. 19, 2008

(86) PCT No.: PCT/FR2008/050469

§ 371 (c)(1),
(2), (4) Date: Sep. 23, 2009

(87) PCT Pub. No.: WO2008/132371

PCT Pub. Date: Nov. 6, 2008

(65) Prior Publication Data

US 2010/0031479 A1 Feb. 11, 2010

(30) Foreign Application Priority Data

Mar. 22, 2007 (FR) ..... 07 53987

(51) Int. Cl.
*A62B 1/14* (2006.01)

(52) U.S. Cl. ..... 24/130

(58) Field of Classification Search ..... 24/71.1, 24/129 R, 130, 129 B, 129 A, 131 R, 129 C; 182/5, 6; 188/65.1, 65.2, 65.4, 65.5
See application file for complete search history.

(56) References Cited

U.S. PATENT DOCUMENTS 4,723,634 A * 2/1988 Fisk ..... 188/65.4

FOREIGN PATENT DOCUMENTS

| | | |
|---|---|---|
| FR | 2821754 A1 * | 9/2002 |
| FR | 2887463 | 12/2006 |
| FR | 2889814 | 2/2007 |

* cited by examiner

*Primary Examiner* — James Brittain
(74) *Attorney, Agent, or Firm* — Dennison, Schultz & MacDonald

(57) ABSTRACT

An accessory for belaying and/or rappelling on a single or double rope. This accessory is a one piece component having a first through hole of a shape allowing a carabiner to be passed through it, a second through hole situated in a central position to the component the said first hole, the second hole allowing at least two strands of the rope to be passed through it, and a slot forming a notch communicating at its top, widest end with the second hole to allow the strand of rope from the second hole to be inserted into and locked in the slot. The accessory also includes between the first hole and the bottom, narrowest end of said slot, a boss extending transversely to the surface of the one-piece component and locally increasing the thickness of the component by at least as much as the diameter of the strand of rope. This boss forms on the surface of the one piece component a rope return element that makes it easier to manually release a strand of rope jammed in the slot.

18 Claims, 7 Drawing Sheets

FIG.2C
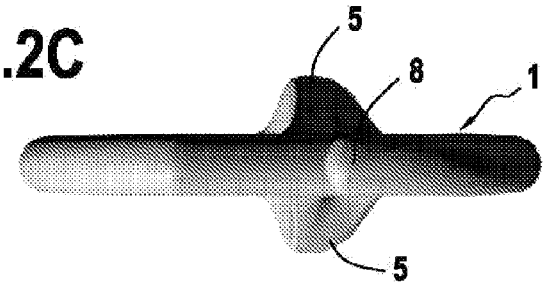
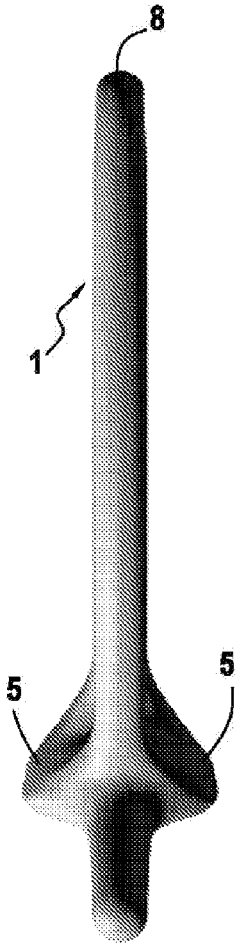
FIG.2A
FIG.1
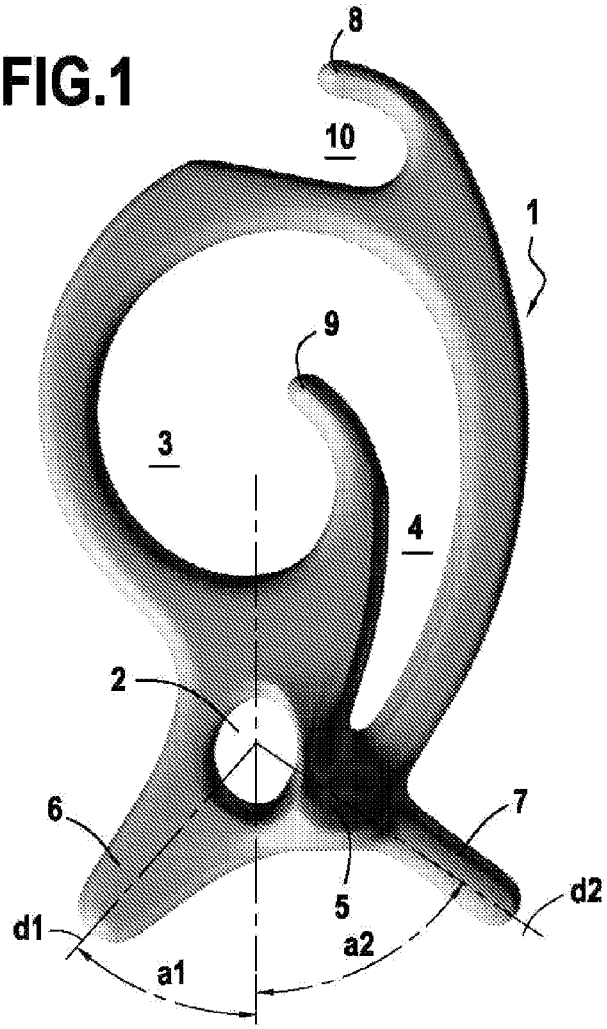
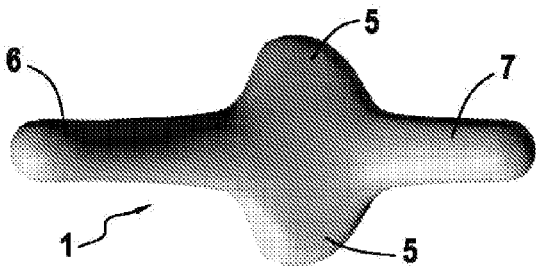
FIG.2B

BELAY AND/OR RAPPELLING ACCESSORY

The present invention relates to apparatus and accessories for activities such as rock climbing, alpinism, mountaineering, canyoneering, caving, aerial hiking and acrobatic work in the context of sporting and professional activities.

The invention relates more particularly to an accessory for belaying and/or rappelling on a single or double rope for the purposes of the above activities.

A great many devices are known, from the simplest to the most complicated, for the various activities listed above.

The best known of these is probably the figure-of-eight, which is a descender consisting of a metal component with two loops of different diameters linked together in the general shape of an 8. There are also very many variants of this descender device. The main disadvantage with these devices is their inability to allow the belay rope or rappel rope to be locked when the user releases said rope, and the result can be dangerous, and even in certain cases fatal, falls.

To alleviate these problems, descender devices provided with a system for automatically locking the rope if the rope is let go of have been developed. Unfortunately, these devices are mostly mechanically complicated, heavy and cumbersome, as well as difficult to use, which greatly limits their use, since under stress the climber may, with mechanical equipment, grab the handle of the release device and therefore fall suddenly.

In addition, mechanical devices can rarely be used in combined sports, such as rock climbing and canyoneering, because exposure to water in canyoneering eventually impairs their operation.

Lastly, no existing rappelling and belay device allows controlled braking of the rope during use and the use of a single or double rope while keeping both hands on the rope.

The object of the invention is to provide an accessory that can be used for rappelling, belaying a team member, or performing rope installation techniques for the purposes of the disciplines mentioned above, such as to alleviate the problems of existing devices.

One particular object of the invention is to provide a rappelling and/or belay accessory comprising a non-mechanical selflocking system that is simple to use and quick to release while keeping both hands on the rope.

Another object of the invention is to provide a rappelling accessory that allows the user to adjust and control the braking of the rope during descent, without a mechanical device, by a simple movement of the rope on the device.

Another object of the invention is also to provide a rappelling and belay accessory comprising a selflocking system that is optional but possible to use, even during a descent, without structural modification of the accessory itself, and which provides progressive and dynamic locking.

These various objects are achieved in accordance with the present invention in the form of an accessory for belaying and/or rappelling on a single or double rope, said accessory being a one-piece component of generally elongate form and able to be held in one hand in the direction of its width. This one-piece component comprises:

- a first hole passing through the full thickness of the base of said component and of a shape allowing a carabiner to be passed through it, and
- a second hole passing through the full thickness of said one-piece component and situated above said first hole, preferably in an approximately central position in said component, said second hole allowing at least two strands of said rope to be passed through it, and

- a slot passing through the thickness and extending along the length of said one-piece component and forming a notch communicating at its top, widest end, with said second hole to allow said strand of rope from said second hole to be inserted into and locked in said slot.

The accessory according to the invention also comprises, characteristically, at least one boss formed on at least one face of said one-piece component between said first hole and the bottom, narrowest end of said slot, the boss extending transversely to the surface of said one-piece component and locally increasing, between said first hole and said slot, the thickness of said component by at least as much as the diameter of said strand of rope.

What is meant here by the base of the one-piece component forming the accessory of the invention is that part of the accessory by which it is connected to the harness of a user by means of a carabiner.

The boss formed on the surface of the one-piece component forming the accessory of the invention advantageously provides a rope return element projecting from the surface of the one-piece component between said first hole and the lower base of the slot, which return element makes it easier to manually release a strand of rope jammed in said slot.

The accessory of the invention can advantageously be used as a descender/belay device in place of traditional descenders. In particular, it makes it possible to rappel or belay on a single rope or on a double rope, with the choice of a variable and optionally selflocking braking system while allowing both hands to be kept on the rope, using 8 to 12 millimeter diameter ropes.

It can thus advantageously be used as a non-selflocking descender, similar to a descender such as a conventional figure-of-eight, while being optionally selflocking because of the rope locking slot which communicates with the central hole of the accessory. Specifically, with the accessory of the invention the down-line rope strand locks automatically when the user releases the rope on which he is descending. This principle of an optionally selflocking descender is so far unique.

Further, the boss provided at the base of the accessory according to the present invention plays an important part in releasing the rope, which, when the accessory of the invention is used, is passed at least through the carabiner connecting the accessory to the climber's or belayer's harness and through the central hole of the accessory, in such a way as to force the rope away from the base of the slot, around the top or outside of said boss when the user lifts the free strand of the rope after locking, which makes it easier to release the rope when the rope is jammed in the slot and thus allows the user to release the rope with one hand without losing balance and without letting go of the rope with his up-line hand.

In a first advantageous feature of the accessory of the invention, said bottom end of said slot is next to said first hole dedicated to the passage of a carabiner and approximately level with it on the one-piece component. Furthermore, the surface of said boss is preferably adjacent to the edge of said first hole and to the edge of said bottom end of said slot, which thus creates bearing and guiding surfaces of the rope around said boss, in an obligatory manner when the rope is passed through the carabiner and when a descent has begun.

A preferred feature of the invention is that the slot of the accessory is an indented and curved V-shaped slot. This curved shape of the slot also contributes to the ease with which the rope can be released from the slot after becoming locked.

In addition, it is also preferable for said slot to comprise on at least one of its edges, and for the lower two-thirds of its length, a rib or beveling. A rib or beveling has the advantage of augmenting the wedging action on said strand of rope in said slot and thus efficiently locking the rope when required.

In a preferred embodiment, the accessory of the invention also comprises at the top end of said one-piece component, at least one horn, termed the top horn, forming a recess through which a strand of rope can be passed to complicate the path and increase the friction of the rope on the accessory.

Generally speaking, the use of the top horn allows the accessory of the invention to be used while keeping one hand down on the rope and removing the rope from the recess bounded by this top horn when the hand pointing downwards releases the rope. This automatically locks the rope in the slot as desired for safety. For the rope to come out in this way, the invention has two particular embodiments of the top horn.

In one embodiment the top horn is relatively straight, not significantly bent, and short, defining a very open recess which allows automatic replacement of the free strand of rope in the locking slot of the accessory if the user lets go of it.

In another embodiment the accessory of the invention may also comprise, if the top horn is longer and bent and therefore forms a deeper recess, an automatic rope ejector housed in the base of the recess formed by said top horn, said ejector comprising a pusher acted upon by an elastic return means placed in a housing formed in the bottom of said recess within said one-piece component.

Such an ejector avoids having the rope become locked in the top horn and therefore ensures that the down-line strand of rope passes safely through the slot and locks in the latter when released by the user.

As a supplementary feature, the accessory of the invention also comprises, at the base of said one-piece component, a first base horn of essentially triangular and ergonomic shape extending from said first hole in a direction d1 forming an angle a1 of between 30° and 90° with respect to a vertical line passing through the center of said first hole.

This horn acts both as a rope return element by forcing it to pass behind said base horn and, more importantly, as an ergonomic hand support so that the user can push with his left hand against this horn to grip the rope correctly during use in order to change the position and path of the rope through the accessory based on braking and safety requirements.

Additionally, the accessory of the invention also preferably comprises, at the base of said one-piece component, a second base horn, preferably approximately straight, extending from said boss in a direction d2 forming an angle a2 of between 30° and 90° with respect to a vertical line passing through the center of said first hole.

This second base horn forces the rope to follow a precise path for locking and releasing functions. It also serves practically in making safety keys and also, together with the top horn, allows controlled braking during use. Lastly, its particular orientation is advantageously designed to avoid the risk of snagging unexpectedly and unintentionally on other equipment.

Another preferred feature of the invention is that the accessory possesses a central horn forming a separation between said second or central hole and said slot, this horn also making it possible to produce if required a simplified safety key with the rope.

In a variant, the central horn may also be hinged on a pivot and returned by an elastic means in such a way as to close the entrance of the locking slot in order temporarily to close the slot and thus prevent the rope from sliding into it. This then allows the accessory of the invention to be used as a traditional descender, without the possibility of locking.

The belay and/or rappelling accessory of the invention is advantageously formed from a one-piece component which may be made of a metal or a metal alloy, or, in a variant, may be made of a synthetic material or a blend of synthetic, especially plastic, materials.

These different materials advantageously allow different qualities, strengths and weights of accessories to be produced based on their potential uses.

Furthermore, all these materials permit rapid, precise manufacture of the one-piece component of the accessory of the invention by molding or machining, which therefore also means that said boss can be made integrally with said one-piece component during the molding or machining of the latter, as can the various horns of the accessory. The strength of the accessory of the invention and of its various parts is thus greatly improved.

The accessory of the invention may also, in an alternative embodiment, comprise a carabiner welded directly into the first hole. In this way even the smallest gap between the right-hand edge of the top of the carabiner and the inside part of the boss is eliminated, making the accessory completely rigid and integral with the carabiner. This can prove useful in preventing accidental or unintended movements between the carabiner and the accessory.

Finally, the accessory of the invention can be offered in straight models, thus offering front/back symmetry, suitable for both right-handed and left-handed users.

The invention can also be offered in models having a curvature in the longitudinal direction, or twisted in the longitudinal direction, for even quicker and simpler release. One and the same accessory cannot then be used for both right-handed and left-handed applications.

The other features and advantages of the invention will become clearer on reading the following detailed description of the invention, given without implying any limitation with reference to the attached figures, in which:

FIG. 1 shows the belay and rappelling accessory of the invention in a front view;

FIGS. 2A-2C show the accessory from FIG. 1 in views from the right, from beneath and from the top, respectively;

Figure 3:
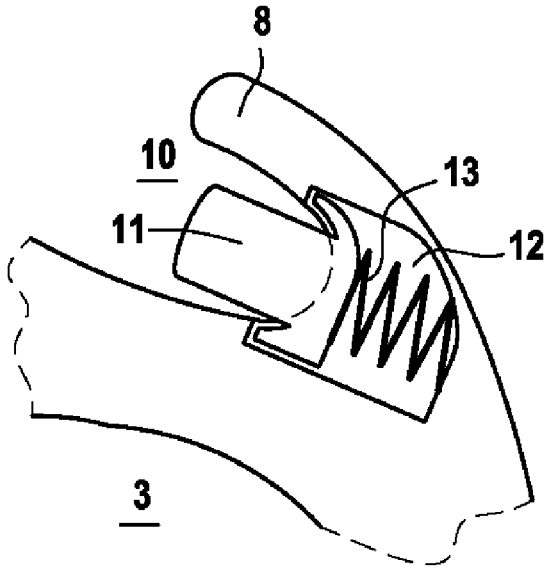
FIG. 3 shows in detail a rope ejector in the recess 10 of the accessory shown in FIG. 1, in one particular embodiment of said accessory.

The accessory 1 of the invention, shown in FIGS. 1-6, is intended for rappelling and belaying in canyoneering and rock climbing, mainly using a single rope, typically an 8 to 12 mm rope in accordance with the UIAA standard.

This accessory makes it possible to simplify the process by facilitating braking and stopping on the rope (no locking key required, or the locking key is simplified), climbing on the rope, and switching from rappelling to climbing or from climbing to rappelling.

Referring initially to FIGS. 1-2C, this accessory 1 is a one-piece component which can be produced as a metal casting, typically in aluminum or a metal alloy such as a steel or aluminum alloy, or as a synthetic molding in thermoplastic or similar material.

This one-piece component is elongate in general shape, and its thickness is approximately constant throughout its length except in two particular areas on both faces (FIGS. 2A and 2C), the reason for which will be explained later. To ensure that the accessory does not cause injuries to its users, the component 1 has no sharp, pointed or cutting angles or edges, although it does have parts 5, 6, 7, and 8 which project from these edges, all performing specific useful functions for the use of the accessory 1 of the invention.

The one-piece component comprises at its base a first hole 2 passing all the way through in the direction of the thickness of the component, this hole 2 being of a generally oval shape and of a size suitable for the passage of a safety carabiner for attaching the accessory 1 to the harness of a user.

Above the hole 2, the accessory 1 has a large central hole 3 of generally oval or approximately circular shape. This large central hole 3 also passes through the full thickness of the one-piece component forming the accessory 1 and communicates with or is extended at its top by an elongate notched slot 4 which is curved all the way along its length and is wider at its top end than at its bottom end.

This slot 4 is separated from the hole 3 by a central horn 9. Its function is to allow automatic locking of the rope when the accessory 1 is in use. For this reason, said slot 4 is relatively wide at its top end, and certainly wide enough to allow a strand of rope suitable for mountain sports, such as a UIAA-standard 8 to 12 millimeter diameter rope to be entered into and slid through the slot 4. It follows of course that the bottom end of the slot 4 is narrower than the top end of the slot 4 and certainly narrow enough to lock a rope the further it slides into the slot, irrespective of the diameter of said rope.

In addition, the internal edges of the slot 4 are preferably beveled, or more preferably still ribbed along the lower two-thirds of the length of the slot 4. This beveling or ribbing of the lower internal edges of the slot 4 is designed to give better locking of the rope in the slot 4 when using the accessory 1 as will be described later with reference to FIGS. 7-18.

Meanwhile, the curved shape of the slot 4 helps the user to release the rope from the accessory, in combination with the effect of detachment or separation of the rope from the slot 4 produced by a boss 5 projecting transversely from each face of the one-piece component exactly between the base hole 2 and the bottom, narrowest end of the slot 4.

This boss 5 forms a rope return element which tends to move the rope away from the slot 4 during use of the accessory. This helps the user release the rope from the slot, particularly enabling release with one hand, by simply pulling on the free strand of the rope without having to let go of it.

In the example illustrated, the boss 5 is shaped somewhat like a pyramid with a triangular base, although this shape is not obligatory. On the other hand, it is important that the height of the projection of the boss 5 above the surface of the accessory is equal to or greater than the thickness of the rope used for rappelling, and therefore, in practice, for the accessory to be suitable in many situations, the height of the boss will preferably be at least 8 millimeters, and still more preferably between 10 and 20 millimeters. The accessory of the invention can thus be used with most ropes commonly used in rope climbing, canyoneering and mountaineering.

In a variant of the accessory 1 which is not shown in the figures, the central horn 9 may be hinged to the base so as to close the top end of the slot 4 so that the rope cannot enter the slot from the central hole 3.

The accessory 1 also comprises a base horn 6 termed the left-hand base horn. Its shape is generally triangular and ergonomic and it extends from the hole 2 in a direction d1 forming an angle a1 of between 30° and 90° with respect to a vertical line D passing through the center of the hole 2.

It also comprises a base horn 7, termed the right-hand base horn, which is preferably approximately straight and extends from the boss 5 in a direction d2 forming an angle a2 of between 30° and 90° with respect to the vertical line D passing through the center of the hole 2.

These two horns 6, 7 form rope return elements for complicating the path of the rope through and around the accessory 1 based on how it is being used, and for increasing the friction of the rope on the accessory 1 and thus helping to slow it during rappelling or belaying.

At the top of the one-piece component forming the accessory 1 there is also a top horn 8 defining by its curved shape a recess 10. This top horn 8 and recess 10 are also provided so that the direction of the rappelling rope can be changed and guided, respectively, depending on the use made of the accessory 1.

In a variant shown in FIG. 3, the accessory 1 comprises an automatic rope ejector housed in the base of the recess 10 formed by said top horn 8. Said ejector comprises a pusher 11 acted upon by an elastic return means such as a spring 13 placed in a housing 12 formed in the bottom of the recess within the one-piece component forming the accessory. This ejector is an additional safety tool for the function of automatic rope locking in the slot 4 when said rope is placed in the recess 10 during rappelling and when the user suddenly lets go of the free strand of the rope.

The ejector then pushes the rope out of the recess 10 and the free strand automatically jams in the slot 4 of the accessory, thus saving the user by preventing him falling.

Figure 4:
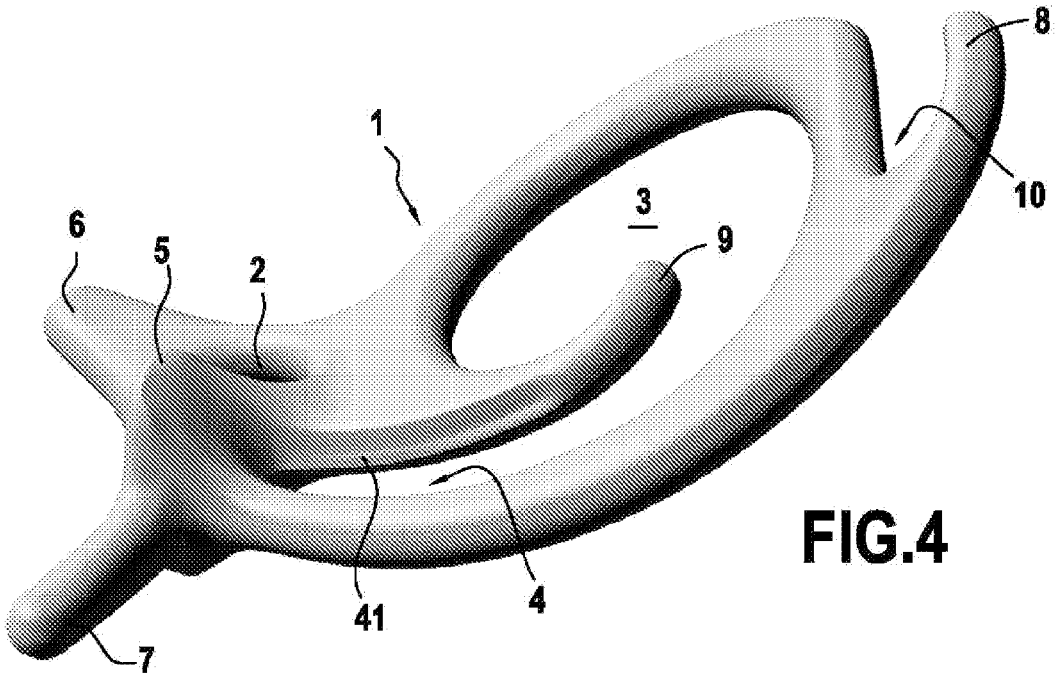
FIG. 4 is a perspective view of the accessory of the invention in a particular embodiment in which the one-piece component forming the accessory has a concave longitudinal curvature.
Figure 5:
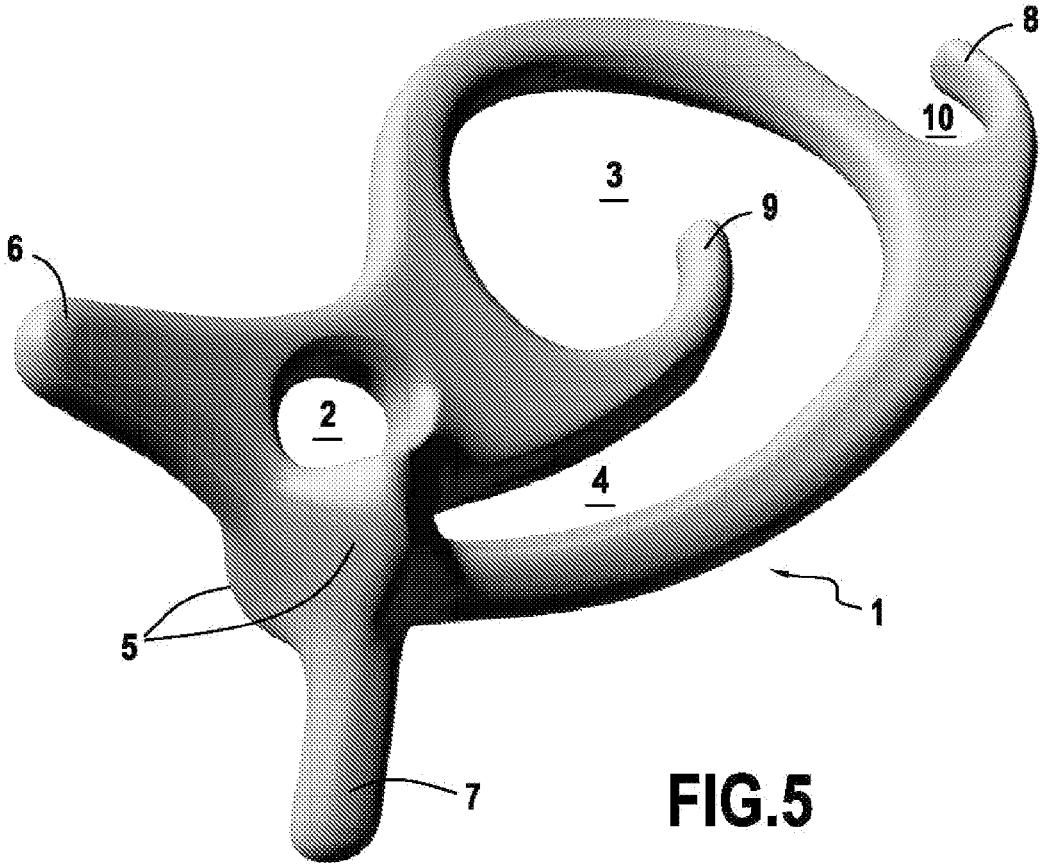
FIG. 5 is a perspective view of the accessory of the invention in another particular embodiment in which the one-piece component forming the accessory has a longitudinal twist.

Shown in a symmetrical and straight configuration in FIGS. 1-2C, the accessory 1 can also be curved as shown in FIG. 4, or twisted as shown in FIG. 5. In these two configurations the accessory 1 makes it easier to handle and release the rope when used for rappelling.

Figure 6:
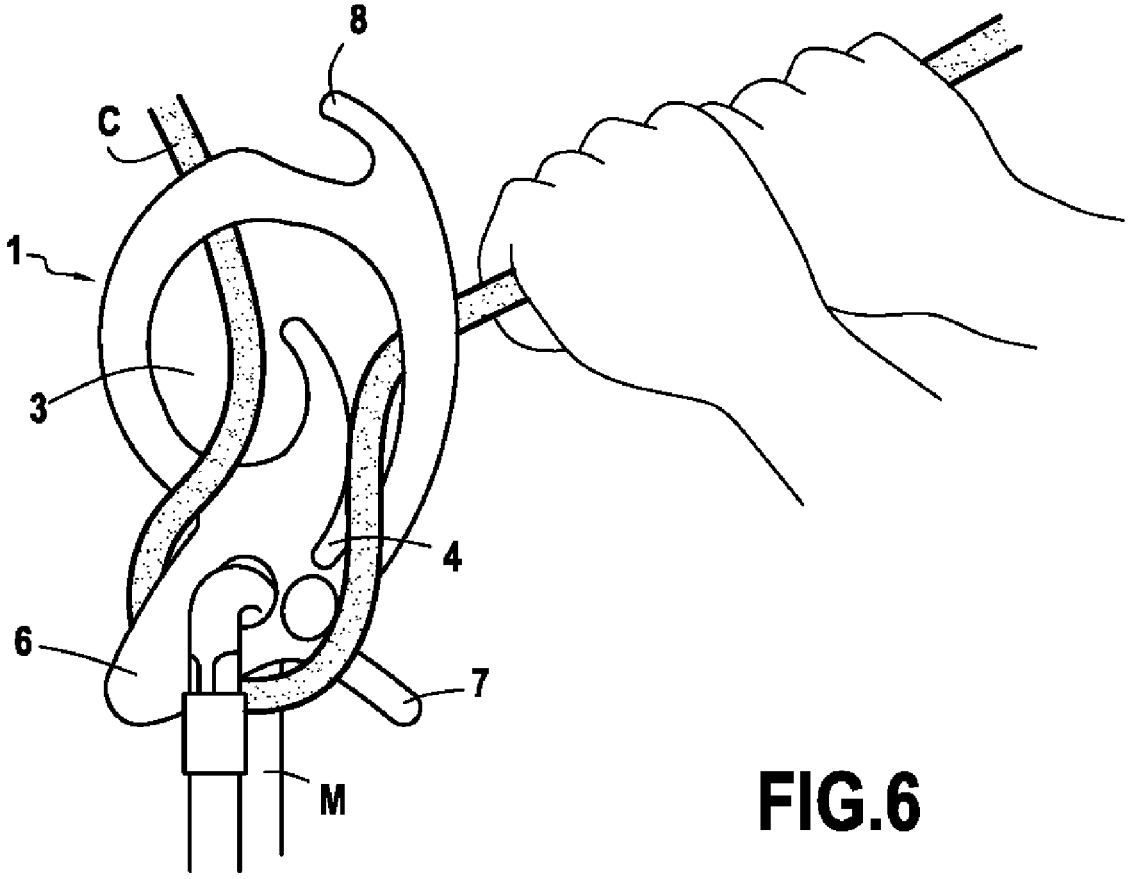
FIG. 6 shows a preferred method of attaching and using the accessory 1 of the present invention in the embodiment shown in FIG. 1.

As shown now in FIG. 6, the accessory 1 of the invention is mainly intended for use as a selflocking descender/belay device on a single rope in a configuration shown in FIG. 6. The accessory 1 is then attached to the user's harness by a carabiner M which is passed through the hole 2 of the accessory, and a rope is passed from underneath through the hole 3, then under the left-hand base horn 6, through the carabiner M, around the boss 5, and then down through the slot 4, the free strand BL of the rope being held in the user's hand and pulled somewhat downwards to control the sliding of the rope while rappelling or even to stop the user by locking it fully in the slot 4.

The various possible ways of using the accessory 1 of the invention will now be described in more detail with reference to FIGS. 7-18.

Figure 7A:
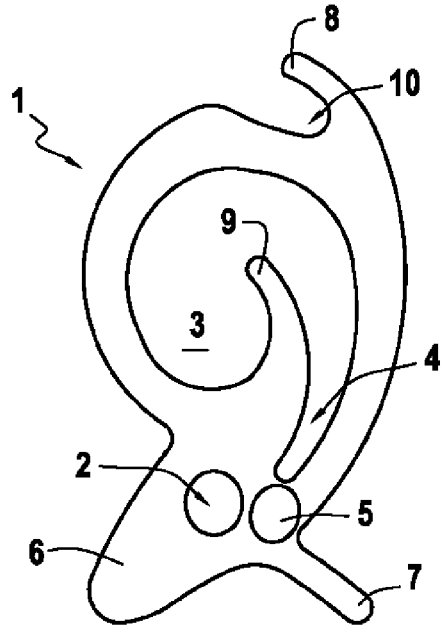
FIGS. 7A and 7B show, respectively, a position of use of the accessory of the invention for right-handed people, and a position of use for left-handed people.
Figure 7B:
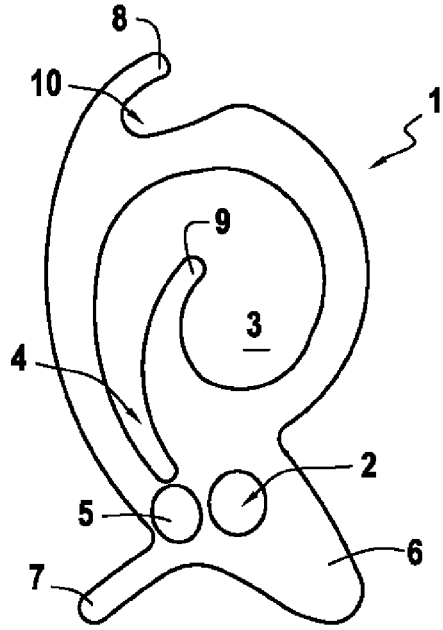

The belay and rappelling accessory 1 of the invention can advantageously, in a straight symmetrical configuration as shown in FIGS. 1-2C, be used with equal convenience by right-handed and left-handed users, the favored position of use for right-handed people being shown in FIG. 7A and that for left-handed people being shown in FIG. 7B.

For the sake of brevity and clarity, the different modes of use of the accessory 1 of the invention are described and shown below in the position indicated in FIG. 7A.

The accessory 1 of the present invention must first be attached to the user's harness B by an HMS safety type (pear-shaped) or symmetrical carabiner M.

Figure 8A:
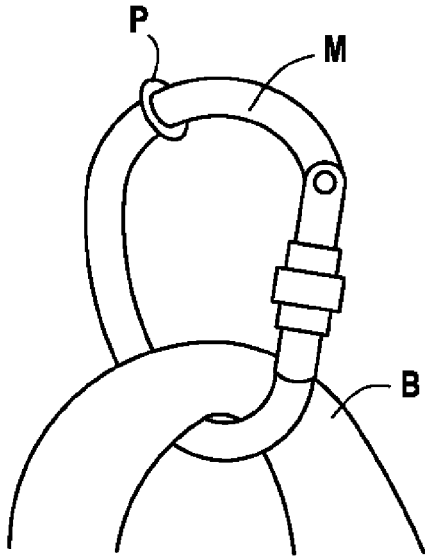
FIGS. 8A and 8B show the method of attachment of the accessory (1) of the invention to a harness (B) using a safety carabiner (M)

If an HMS safety carabiner M as shown in FIG. 8A is used, the user should preferably first install on the carabiner M a lock ring P, often called a "pinch" by climbers, so that the accessory 1 cannot flip during use onto the rear side of the carabiner M.

Figure 8B:
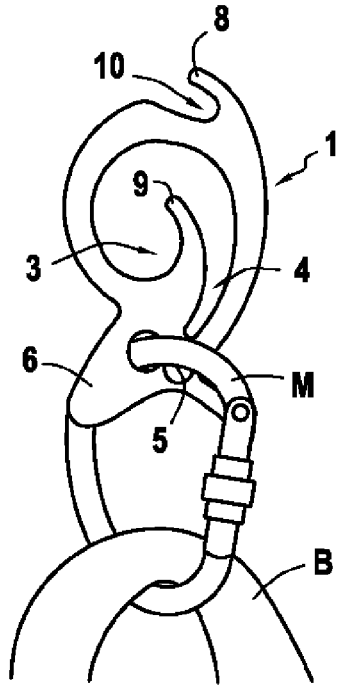

The carabiner M is then attached to the user's harness B and the accessory 1 is attached "unlosably" by its base hole 3 to said carabiner M as shown in FIG. 8B.

Then to finish, the rope C is threaded through the accessory 1 and through the carabiner M before beginning a rappel descent or belaying from the ground another who is rock climbing. For this purpose the user makes a loop of rope, passes it from beneath through the central hole 3 of the accessory 1 of the invention, and hooks it into the carabiner M, as illustrated in FIG. 9.

Figure 9A:
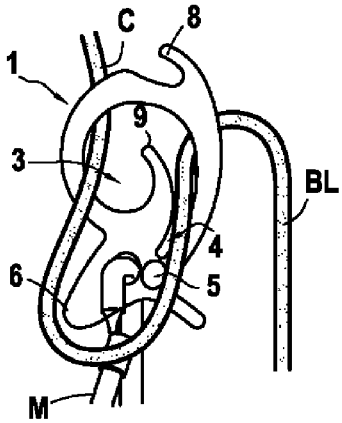
FIGS. 9A and 9B show the method of installing a rope (C) in the accessory (1) of the invention in a first preferred so-called self-locking method of use.
Figure 9B:
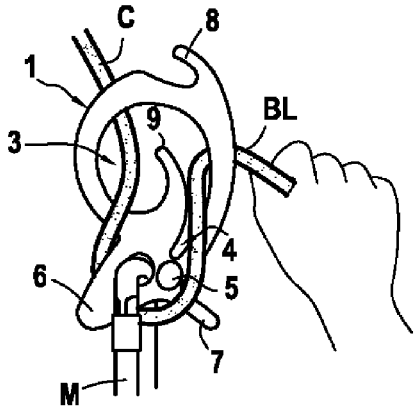

It is preferable, when passing the loop of rope through the carabiner M, to also hook it under the left-hand base horn 6 of the accessory 1 as shown in FIG. 9. Passing the rope C under the horn 6 allows better locking and releasing when the accessory 1 is used in the selflocking descender/belay device positions as described later.

Once the rope is threaded through the carabiner M, the free strand BL of the rope (the down-line strand or slack strand) should be inserted into the axis of the slot 4 of the accessory 1 and then held in the hand and pulled down to lock the rope C.

Figure 10:
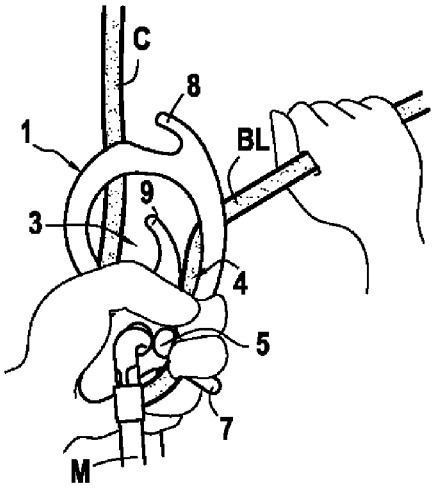
FIG. 10 shows the method of using a "rope pinching" technique with the accessory of the invention.

Use of the accessory 1 of the invention requires users to have understood and mastered a technique known as "rope pinching". This technique is shown in FIG. 10 and is made possible by the ergonomic shaping and relatively narrow width of the base of the accessory 1 above the left-hand base horn 6. This ergonomic shaping allows the user to switch from a first position of use of the accessory known as "selflocking" (FIGS. 9-13) to a second, non-selflocking position as in a traditional free descender (FIGS. 15 and 16) by placing the left hand against the body of the accessory, as shown in FIG. 10.

FIGS. 9-13 show the mode of use of the accessory 1 of the invention in the selflocking position.

The expression "selflocking position" is used here because in this position the slot 4 of the accessory 1 will automatically lock the free strand BL of the rope—which is normally held by the user's right hand (or left hand for left-handed people) during rappelling or belaying, when the user lets go of said free strand.

Figure 11A:
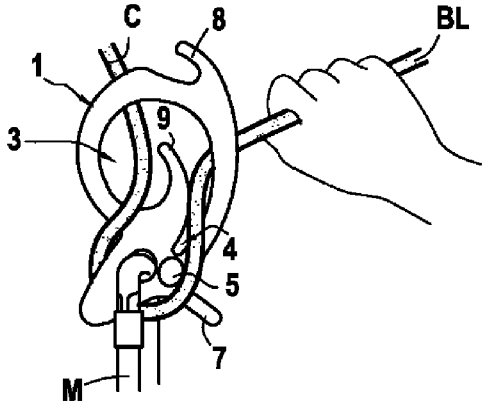
FIGS. 11A and 11B show the respective basic actions to be performed when using the accessory of the invention in self-locking mode.
Figure 11B:
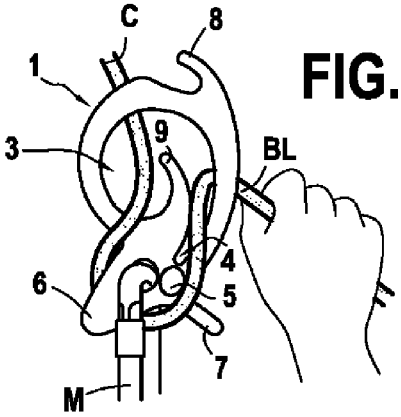
Figure 12:
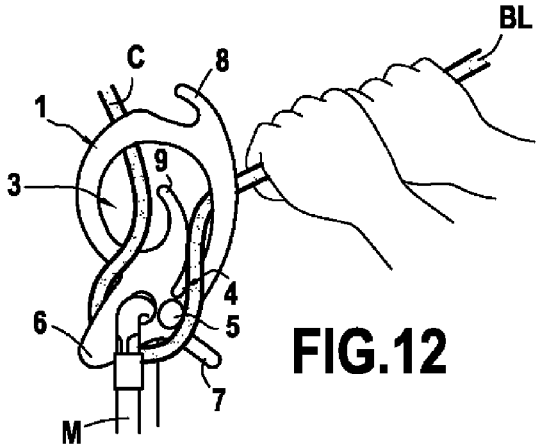
FIG. 12 shows the rope release mode in the selflocking mode of use of the accessory of the invention.

In this position, rappelling (or belaying) is performed as shown in FIGS. 11A, 11B and 12. Beginning with the rope installed position depicted in FIG. 9, the user grips and controls the descent on the rope by pushing the free strand BL of the rope up (FIG. 11A) to allow descent, and pulling the free strand BL down (FIG. 11B) to slow the descent and finally locking the rope C in the slot 4 and stopping the descent. To release the rope C and continue the descent, the user must again with his right hand push and pull the free strand BL up as shown in FIG. 12.

In this selflocking position, the function of the base horn 6 is very important because it is responsible for a large part of the braking action on the rope C during the descent.

In the same way the boss 5 located between the hole 3 containing the carabiner M and the base of the slot 4 plays an essential part in releasing the rope C, in that it tends to force the rope out of the slot 4 when the user pushes the free strand BL of the rope up to release the rope. The boss 5 is also involved in slowing the rope during the descent, thus helping the user to control the downward movement.

In all cases it is important to always keep one hand firmly grasping the free strand BL of the rope to control the descent. If the free strand of the rope is released, it will lock automatically in the slot 4 of the accessory 1 and stop the descent, thus keeping the user safe. After correcting his position, the user can then resume the rappel in the normal way releasing the rope as shown in FIG. 12.

Figure 13:
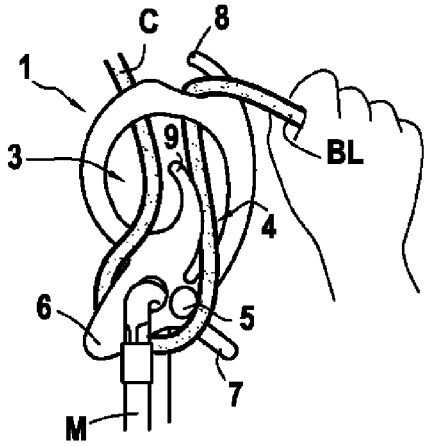
FIG. 13 shows one particular position of use of the accessory of the invention in its selflocking mode of use with the hand downwards.

It is also possible in the selflocking position of use of the accessory 1 to perform a rappel without immediate selflocking yet still have the security of automatic locking of the free strand BL of the rope in the event that the user lets go of it. This possibility is shown in FIG. 13. Here, the free strand BL of the rope is placed in the slot 4. Then, instead of pulling this strand BL directly down in the rope locking direction, the strand BL is drawn up into the recess 10 of the accessory 1 defined by the top horn 8 of said accessory, and the free strand BL is pulled down. It is then possible to rappel while controlling the descent in the traditional way with the right hand holding the free strand BL and pulling down.

However, when using the top horn 8, the accessory 1 is no longer automatically selflocking, unless it comprises an ejector in the recess 10, as shown in FIG. 3, capable of pushing the rope out of the recess, or if, in a variant which is not illustrated, the horn 8 is shorter and oriented more vertically, creating a very open recess from which the rope will flick out automatically in the absence of traction on the free strand BL.

Then, in the event that the free strand BL is released, this end will automatically flick out of the recess 10 and be guided into the slot 4 by the central horn 9 of the accessory, at which point the rope will automatically lock.

Figure 14A:
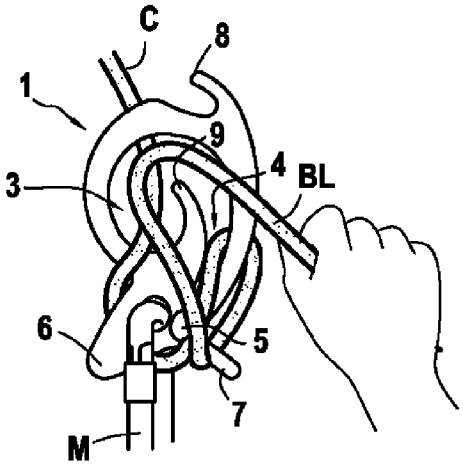
FIGS. 14A and 14B show steps in making a simplified safety key using the accessory of the invention in the latter's selflocking mode of use.
Figure 14B:
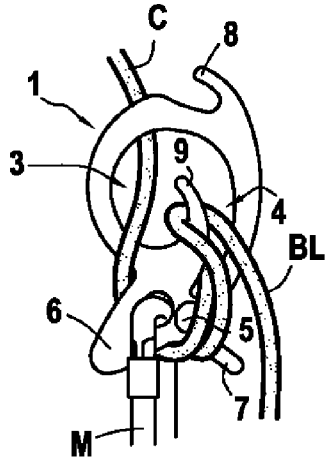

Finally, it is also possible in this selflocking position of use of the accessory 1 to stop completely while rappelling down the rope C by making a simplified locking key on the central horn of the accessory 1 as shown in FIGS. 14A and 14B.

For this purpose, the user should first securely lock the free strand BL of the rope by pulling it down to lock the rope in the bottom of the slot 4, before passing the strand BL up around the right-hand base horn 7 and towards the central hole 3, passing it once around the central horn 9, and finally drawing the free strand BL once again along the slot 4.

Figure 15:
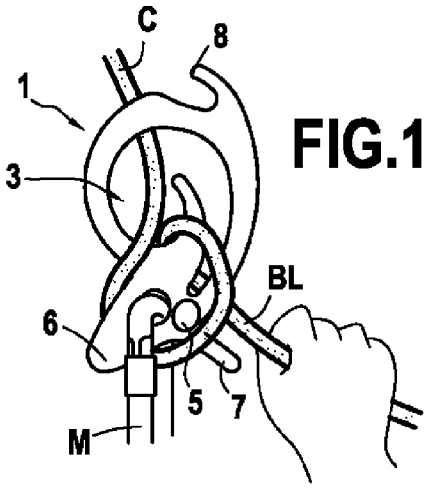
FIGS. 15 and 16 show a second mode of use, termed the non-selflocking or conventional mode, of the accessory of the invention.
Figure 16:
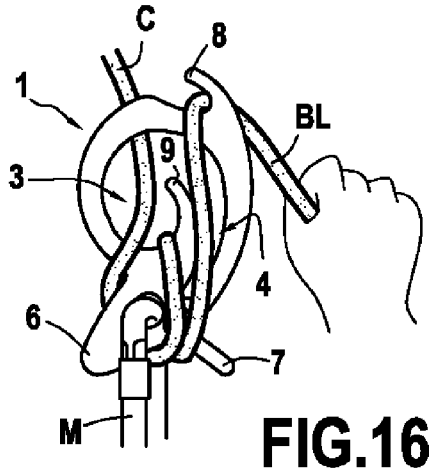

A second position of use is shown in FIGS. 15 and 16. In this position the accessory 1 is used as a traditional "unlosable" free descender with the difference, however, that it provides multiple possible ways of arresting the descent by means of the top horn 8 and right-hand base horn 7. However, the use of the accessory 1 in this position is not selflocking. It should therefore be used mainly, for example, for rappelling under a waterfall. One hand should then always be kept firmly on the free strand BL of the rope C, or else a simplified locking key should be made on the central horn 9 and right-hand base horn 7.

In this position of use, the free strand BL of the rope is not fed through the slot 4 of the accessory 1 but through the central hole 3 as in using a conventional figure-of-eight, as shown in FIG. 15. The free strand BL is then pulled downwards all the time and the user directs and controls his descent down the rope C by the strength of his arms.

As FIG. 16 shows, it is also possible in this traditional descender position to organize a rope path through the accessory 1 around the right-hand base horn 7 and around the top horn 8 to increase the braking action on the rope C while rappelling and thus have more control over operations.

While rappelling it is possible to switch from the selflocking position of FIGS. 9-13 to the traditional descender position of FIGS. 15 and 16, and vice versa, by locking the rope C with the left hand grasping the body of the accessory 1 to perform a rope pinch, while the other hand changes the position of the free strand BL of the rope C by moving it from the slot 4 to the central hole 3 of the accessory 1 and vice versa.

Figure 17:
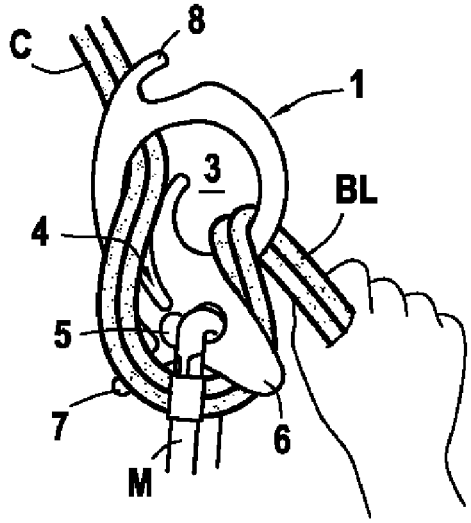
FIGS. 17 and 18 show the method of installing and using the accessory of the invention with a double rope.
Figure 18:
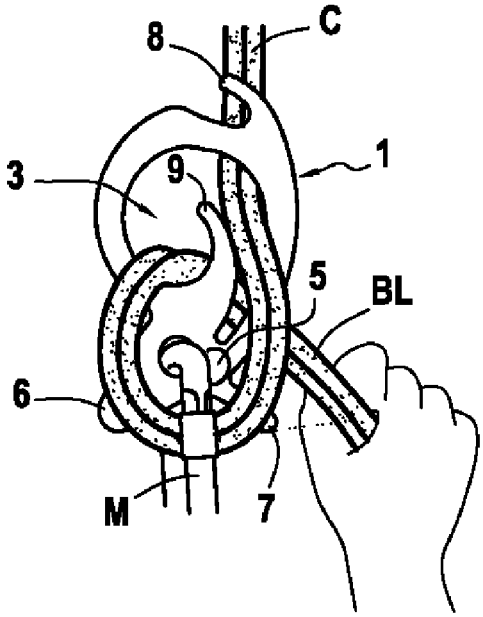

One more possibility, shown in FIGS. 17 and 18, is to use the accessory 1 of the invention for rappelling or belaying on a double rope, meaning with two strands of rope.

To do this, it is then preferable to turn the accessory 1 front to back on the safety carabiner M, reversing its right/left position as shown in FIG. 17. The double rope is then fed up from beneath the accessory 1 into the slot 4, then over the base horn 7, through the carabiner M, under the horn 6, and finally threaded back down through the central hole 3. The free strand is then pulled down.

Expert users do not have to turn the descender 1 over and can then place the double rope in a cross as shown in FIG. 18—that is, with the free strands not in the slot 4 but in the central hole 3. This gives a fluid feed and avoids the risk of one of the two down line strands becoming jammed in the slot.

Contrary to the preceding description of rappelling on a single rope, the use of the accessory 1 on a double rope is not in all cases selflocking. One hand must always be kept tightly on the two free strands of the rope.

The invention claimed:

1. An accessory for belaying and/or rappelling on a single or double rope, said accessory being a one piece component, of generally elongate form, and able to be held in one hand in its width and thickness, said one piece component comprising:

a base with a first hole passing through the full thickness of the base of said component and of a shape allowing a carabiner to be passed through it, and a second hole passing through the full thickness of said component and situated above said first hole, said second hole allowing at least two strands of said rope to be passed through it, and a slot passing through the thickness and extending along the length of said one piece component, said slot comprising a bottom end and a top end, said top end of said slot being wider than said bottom end of said slot, and said slot forming a notch communicating at a top end of said notch with said second hole to allow said strand of rope from said second hole to be inserted into and locked in said slot, wherein said accessory also comprises at least one boss extending transversely from at least one face of said one piece component between said first hole and the bottom end of said slot and locally increasing, between said first hole and said slot, the thickness of said component by at least as much as the diameter of said strand of rope.

2. The accessory as claimed in claim 1, wherein said bottom end of said slot is next to said first hole and approximately level with it on said one piece component.

3. The accessory as claimed in claim 1, wherein said boss comprises a surface that is adjacent to an edge of said first hole and to an edge of said bottom end of said slot.

4. The accessory as claimed in claim 1, wherein said slot is curved.

5. The accessory as claimed in claim 1, wherein said slot comprises beveling or a rib on at least one of its edges.

6. The accessory as claimed in claim 1, wherein said top end of said one piece component comprises at least one top horn said top horn forming a recess through which a strand of rope can be passed to complicate the path and increase the friction of the rope on the accessory.

7. The accessory as claimed in claim 6, comprising an automatic rope ejector housed in the bottom of the recess formed by said top horn, said ejector comprising a pusher acted upon by an elastic return means placed in a housing formed in the bottom of said recess within said one piece component.

8. The accessory as claimed in claim 1, comprising, at the base of said one piece component, a first base horn of essentially triangular and ergonomic shape extending from said first hole in a direction dl forming an angle al of between 30° and 90° with respect to a vertical line passing through the center of said first hole.

9. The accessory as claimed in claim 8, comprising, at the base of said one piece component, a second base horn extending from said boss in a direction d2 forming an angle a2 of between 30° and 90° with respect to a vertical line passing through the center of said first hole.

10. The accessory as claimed in claim 1, comprising a central horn forming a separation between said second, central hole and said slot.

11. The accessory as claimed in claim 1, wherein said second hole is in an approximately central position in said one piece component.

12. The accessory as claimed in claim 1, wherein said one piece component is made of a metal or a metal alloy.

13. The accessory as claimed in claim 1, wherein said one piece component is made of a synthetic material or a blend of synthetic materials.

14. The accessory as claimed in claim 1, wherein said one piece component is made by molding or machining.

15. The accessory as claimed in claim 14, wherein said boss is formed integrally with said one piece component during the molding or machining of the latter.

16. The accessory as claimed in claim 1, wherein said one piece component has a curvature in the longitudinal direction.

17. The accessory as claimed in claim 1, wherein said one piece component has a twist in the longitudinal direction.

18. The accessory as claimed in claim 1, comprising a carabiner welded into said first hole.

* * * * *